US007296641B2

(12) United States Patent
Hadin et al.

(10) Patent No.: US 7,296,641 B2
(45) Date of Patent: Nov. 20, 2007

(54) ROCK DRILL BIT HAVING OUTER AND INNER ROCK-CRUSHING BUTTONS

(75) Inventors: Per-Ola Hadin, Järbo (SE); Fredrik Björk, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 224 days.

(21) Appl. No.: 11/206,822

(22) Filed: Aug. 19, 2005

(65) Prior Publication Data

US 2006/0060389 A1 Mar. 23, 2006

(30) Foreign Application Priority Data

Sep. 21, 2004 (SE) ..... 0402283

(51) Int. Cl.
*E21B 10/36* (2006.01)

(52) U.S. Cl. ..... 175/418; 175/419

(58) Field of Classification Search ..... 175/415, 175/417, 418, 419, 420
See application file for complete search history.

(56) References Cited

U.S. PATENT DOCUMENTS

| | | | |
|---|---|---|---|
| 3,357,507 A | 12/1967 | Stewart | |
| 3,955,635 A | 5/1976 | Skidmore | |
| 4,598,779 A | 7/1986 | Liljekvist et al. | |
| 4,862,976 A | 9/1989 | Meek | |
| 5,743,345 A | 4/1998 | Hollar et al. | |
| 5,794,728 A | 8/1998 | Palmberg | |
| 5,890,551 A | 4/1999 | Lijebrand et al. | |
| 6,494,275 B2 | 12/2002 | Asberg et al. | |
| 6,971,458 B2 * | 12/2005 | Kriesels et al. | 175/339 |
| 7,207,402 B2 * | 4/2007 | Bjork | 175/418 |
| 2001/0018990 A1 | 9/2001 | Asberg et al. | |
| 2003/0230433 A1 | 12/2003 | Hedlund et al. | |
| 2004/0065482 A1 | 4/2004 | Larsson | |
| 2005/0072602 A1 | 4/2005 | Pascale et al. | |
| 2006/0162965 A1 | 7/2006 | Hadin | |
| 2006/0213691 A1 | 9/2006 | Barton et al. | |
| 2006/0249309 A1 | 11/2006 | Cruz | |

FOREIGN PATENT DOCUMENTS

| | | |
|---|---|---|
| WO | WO 2006/033606 A1 | 3/2006 |
| WO | WO 2006/054933 A1 | 5/2006 |

* cited by examiner

*Primary Examiner*—William P Neuder
(74) *Attorney, Agent, or Firm*—Drinker Biddle & Reath LLP

(57) ABSTRACT

A rock drill bit for percussive drilling includes a front face which has radially outer and inner portions. Fluid channels are disposed in the head portion in communication with the inner portion of the front face. The inner portion of the front face carries a plurality of front buttons. The outer portion comprises circumferentially spaced steel portions which are axially raised relative to the inner portion. Each raised portion carries one or two peripheral buttons located radially outwardly of an imaginary circle which intersects at least two of the front buttons and at least two of the flushing channels. The imaginary circle is arranged coaxially relative to the center axis.

16 Claims, 2 Drawing Sheets

ROCK DRILL BIT HAVING OUTER AND INNER ROCK-CRUSHING BUTTONS

The present application claims priority under 35 U.S.C. § 119 to Patent Application Serial No. 0402283-6 filed in Sweden on Sep. 21, 2004.

TECHNICAL FIELD OF THE INVENTION

The present invention relates to a rock drill bit for percussive drilling, especially top hammer drilling.

From U.S. Pat. No. 5,890,551 a rock drill bit is previously known, which has an appurtenant drill rod. The rock drill bit at the front face thereof is provided with cemented carbide buttons that work the rock by impacting thereupon during simultaneous rotation. A cavity is formed in the front face, and a fluid channel extends through the drill bit for supplying flushing fluid to the cavity. The cavity is completely bordered by an endless land. Some of the buttons are mounted in the land. Others of the buttons are mounted in the cavity in order to be cooled and flushed by a cushion of flushing fluid created in the cavity. In some cases the cavity has been clogged by debris.

U.S. Pat. No. 4,598,779 shows another rock drill bit of the percussive type for drilling straight holes. The known drill bit does not have an optimal flushing.

OBJECTS AND SUMMARY OF THE INVENTION

The present invention has an object of providing a rock drill bit of the kind defined in the introduction, with extended service life.

Another object of the present invention is to provide a rock drill bit that permits good rock removal.

Still another object of the present invention is to provide a rock drill bit for drilling straight holes.

Still another object of the present invention is to provide a rock drill bit with efficient flushing.

Still another object of a preferred embodiment of the present invention is to provide a rock drill bit that is more easily reground.

The objects of the present invention are realized by a rock drill bit for percussive drilling. The drill bit comprises a head portion defining a longitudinal center axis and including a front face. The front face includes radially outer and inner portions. Fluid channels are disposed in the head portion in communication with the inner portion of the front face. The inner portion carries a plurality of inner buttons. The outer portion comprises circumferentially spaced steel portions that are axially raised relative to the inner portion. Each raised portion carries at least one, but not more than two, peripheral buttons located radially outwardly of an imaginary circle which intersects at least two of the front buttons and at least two of the flushing channels. The imaginary circle is arranged coaxially relative to the center axis.

BRIEF DESCRIPTION OF THE DRAWINGS

An embodiment of the rock drill bit according to the present invention will be described below, reference being had to the accompanying drawings, wherein.

DESCRIPTION OF PREFERRED EMBODIMENTS OF THE PRESENT INVENTION

Figure 1A:
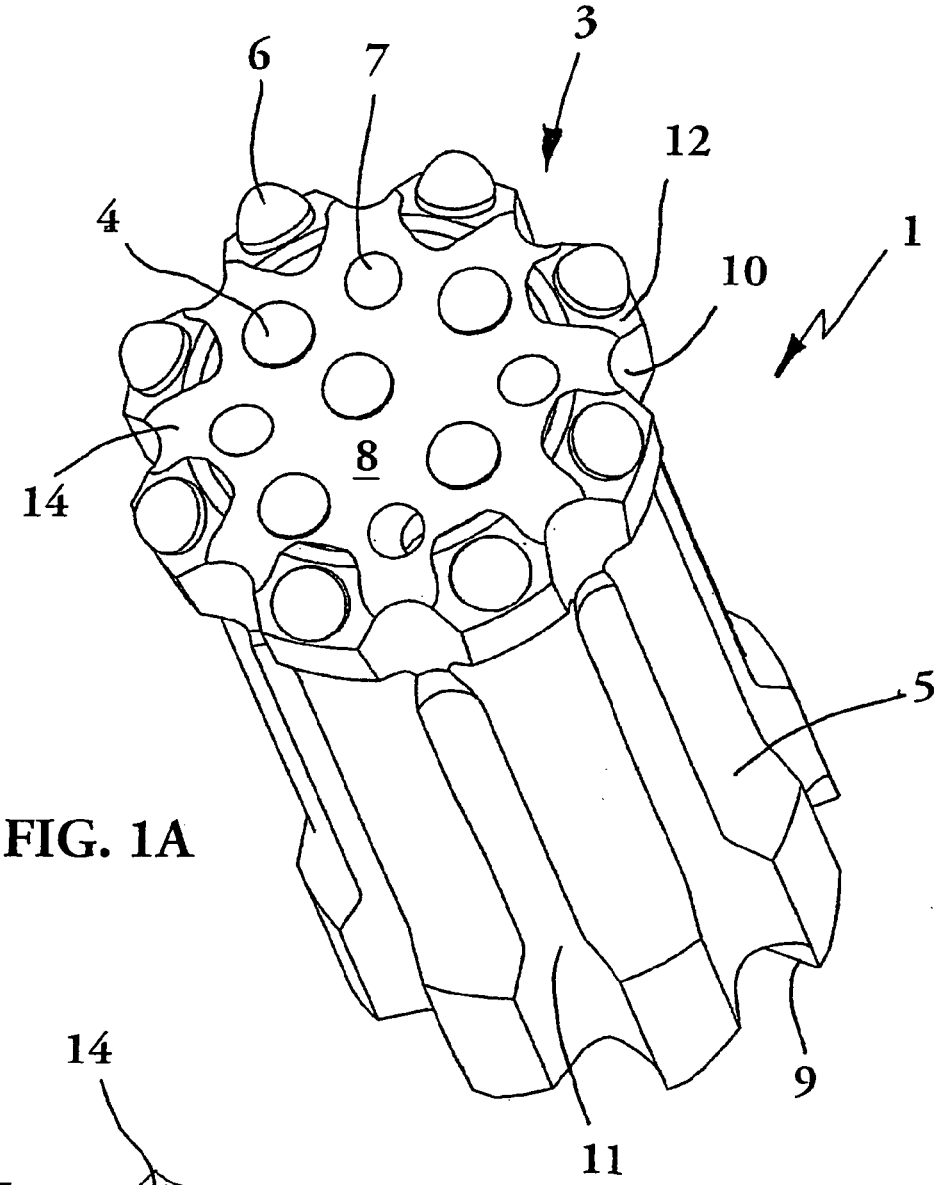
FIG. 1A shows a perspective front view of a rock drill bit according to the present invention.

The percussive rock drill bit 1 illustrated in FIGS. 1A-1D comprises a bit body 2 having a head portion or a drill head 3 and a shank or a skirt 5. The drill head 3 and the skirt 5 are rigidly integrated with each other. A drill rod, not shown, is supposed to be connected to the rock drill bit 1 via a thread coupling.

In the drill rod, a through-going flush duct is arranged in a conventional way. A longitudinal center axis CL of the rock drill bit 1 is shown in FIG. 1D. The rock drill bit 1 is preferably provided with an internal (female) thread, not shown, supposed to receive an external (male) thread at one end of the drill rod.

The drill head 3 of the rock drill bit 1 according to the present invention is provided with rock removing members preferably in the form of cemented carbide buttons, i.e., front or inner buttons 4 and peripheral buttons 6. At least one cooling medium channel 7 extends between an internal space of the rock drill bit 1 (which is surrounded by the internal thread) and a front face 8 of the drill head 3. The front face 8 defines a plane P that is substantially perpendicular to the center axis CL. In said internal space, a first stop face, a so-called bottom stop, is preferably arranged for abutting the free end of the drill rod. A number of retrac edges 9 is preferably arranged at the rear end of the rock drill bit 1, as is shown in FIG. 1A.

Figure 1D:
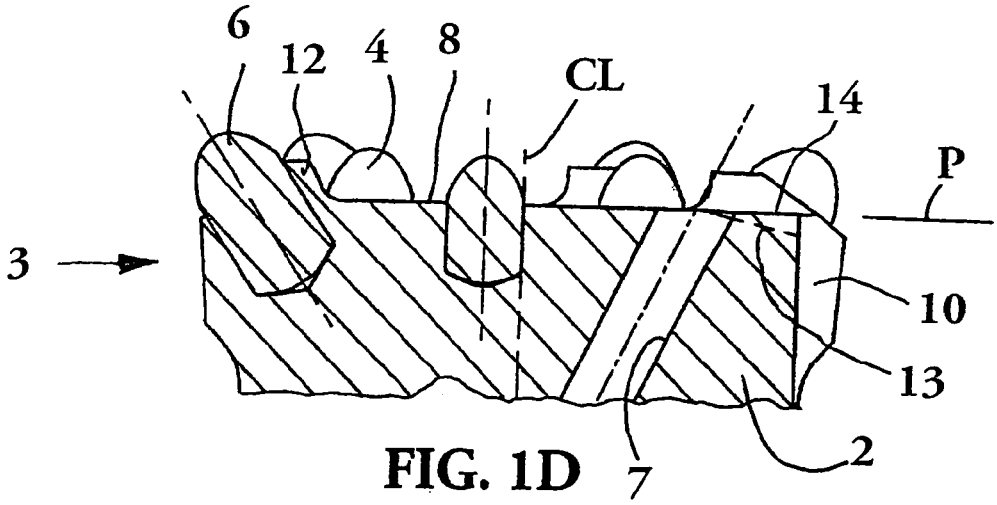
FIG. 1D shows a cross-section through the rock drill bit according to line D-D in FIG. 1A.

As is most clearly seen in FIG. 1A, the rock drill bit 1 is on the outside thereof provided with a number of front 10 and rear 11 straight peripheral grooves for cuttings, extending in the axial direction of the rock drill bit 1. Each front groove 10 is symmetrically arranged in relation to a line parallel with the center axis CL. The front grooves 10 are provided between respective pairs of peripheral buttons 6 in the bit body, the peripheral buttons arranged in a wreath-like pattern about the axis CL. Eight peripheral buttons 6 are mounted in the drill head 3 although there could alternatively be arranged any of 5 to 10 buttons. Each peripheral button 6 is tilted outwardly relative to the center axis CL to define the maximum diameter of the drill bit. The diameter of a peripheral button 6 is preferably greater than the diameter of a front button 4.

Each peripheral button 6 is arranged in a steel segment defined by an axially raised (advanced) portion 12 at least partially projecting axially forwardly relative to the plane P. Each raised portion is integrated with the body 2 at a location radially outwardly of a radially inner portion of the front face, and is generally directed forwardly, i.e., in the working feed direction of the drill bit. A hole, not shown, is formed in the raised portion to receive one peripheral button 6. Alternatively, there could be two peripheral buttons positioned in each raised portion. Each raised portion 12 is circumferentially spaced from another adjacent raised portion by part of the front face 8 or by an additional front groove 13 (as depicted by the dashed line in FIG. 1D). The outer portion comprises a number of circumferentially spaced, raised portions 12 equal to the number of peripheral buttons 6 when each raised portion 12 carries only one peripheral button 6.

Each peripheral button 6 projects axially forwardly beyond all front buttons 4. The common planar, axially foremost level of the front buttons 4 is spaced rearwardly in relation to the common planar, axially foremost level of the surrounding peripheral buttons 6. Thereby, a greater guiding moment is achieved by raising the wreath of peripheral buttons 6 above the front face 8 and the front buttons 4. The raised portions 12 are spaced by a radial passage or part 14 of the front face 8 to allow an unobstructed flow of flushing medium therebetween.

The peripheral buttons 6 are mounted in the drill head 3 radially outside of an imaginary circle C intersecting at least two front buttons 4 disposed on a radially inner portion of the front face, and at least two flushing channels 7 arranged generally annularly around the center axis CL of the drill bit 1. The front buttons 4 are mounted in the front face 8 radially inside of the peripheral buttons 6. Orifices of the fluid channels 7 are arranged in the plane P axially below (behind) the raised portions 12. The raised portions 12 are arranged radially outside of the imaginary circle C intersecting four or at least two front buttons 4 and four or at least two flushing channels 7 arranged generally annularly around the center axis CL of the drill bit 1. The front face 8 ends at the peripheral grooves 10 formed in the bit body 2. The imaginary circle C intersecting the fluid channels 7 also intersects an equal number of front buttons 4. Major parts of the peripheral buttons 6, which buttons usually are from 5 to 10 in number, are mounted in the front face 8 radially outside of the circle C. The additional front groove is formed between each peripheral groove 10 and the front face 8. The front groove is in the form of a bevel 13 sloping outwardly relative to the longitudinal center axis CL and rearwardly relative to the front face. The front groove may alternatively follow a curve that is generally sloping outwardly and rearwardly in relation to CL.

In practice all buttons are advantageously made of cemented carbide, possibly diamond-enhanced. The shape of the buttons can be spherical, conical, ballistic, semi-ballistic or chisel shaped.

The geometry of the rear end of the drill bit comprises retrac teeth that are positioned at the maximum diameter of the drill bit, as well as inside of the same, at the end generally facing away from the rock removing end of the rock drill bit. Although the disclosed embodiment shows retrac edges, it is possible to provide the drill head on a drill bit with other types of skirts. The purpose of the rear end of the drill bit is to make sure that guiding of the drill bit 1 in the bore hole is carried out by means of the portions that are located in connection with the ends of the rock drill bit 1, and to decrease the resistance against the release of cutting dust. The grooves for cuttings 10, 11 are intended to transport away the drill dust produced at the front of the rock drill bit 1.

Preferably, the drill head is machined or milled to produce the front face 8 and the raised portions 12. Milling tests have shown that the time period for milling the front of the drill bit according to the present invention can be reduced by about 20% as compared to conventional drill bits.

Figure 2:
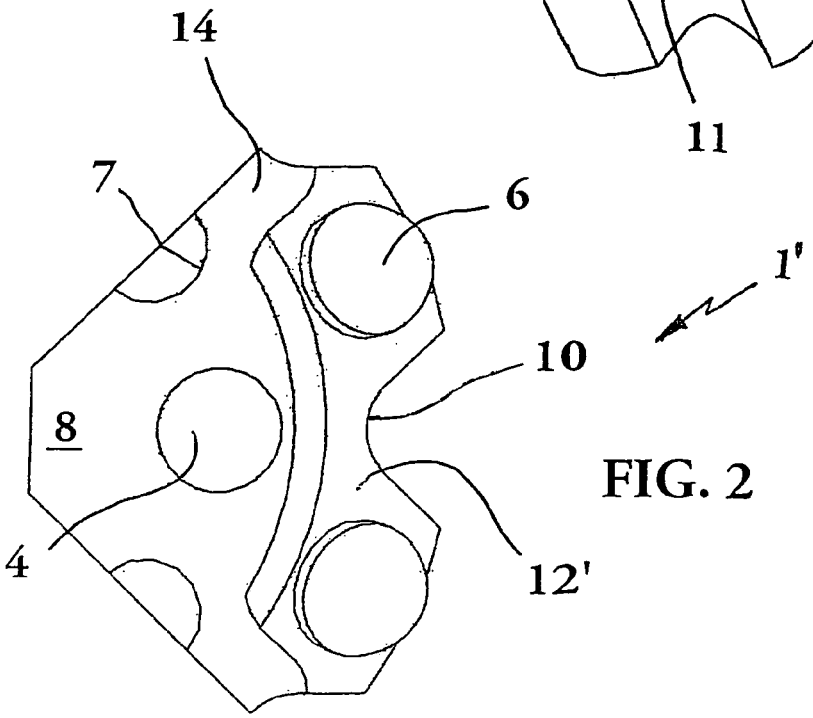
FIG. 2 shows a quarter of an alternative embodiment of a rock drill bit according to the present invention in a front view.
Figure 1B:
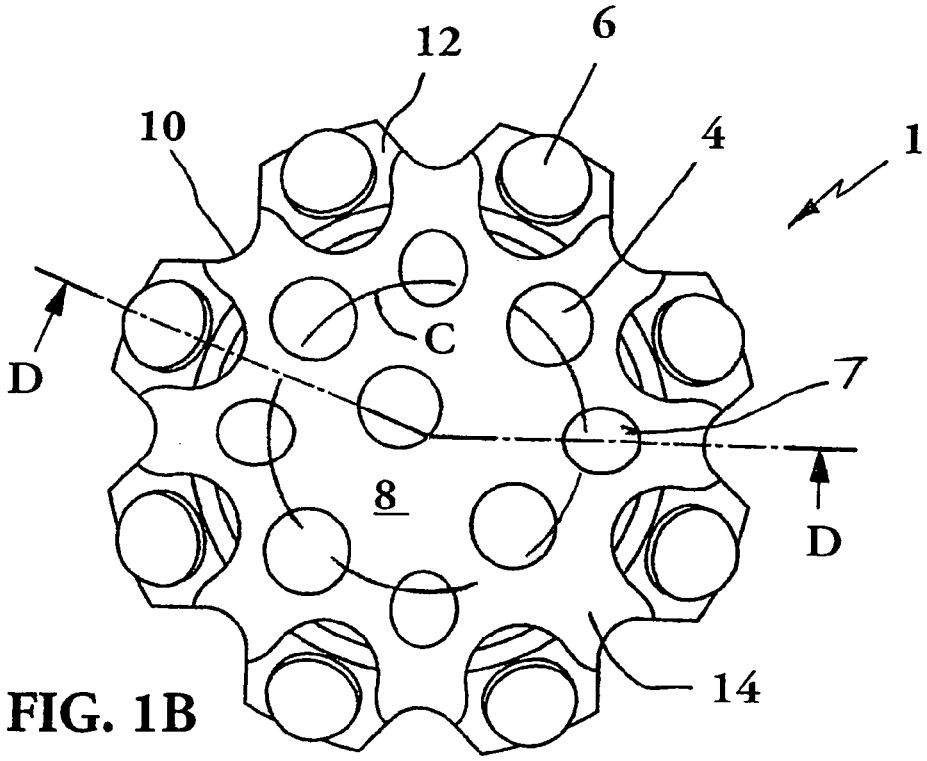
FIG. 1B shows a front view of the rock drill bit.
Figure 1C:
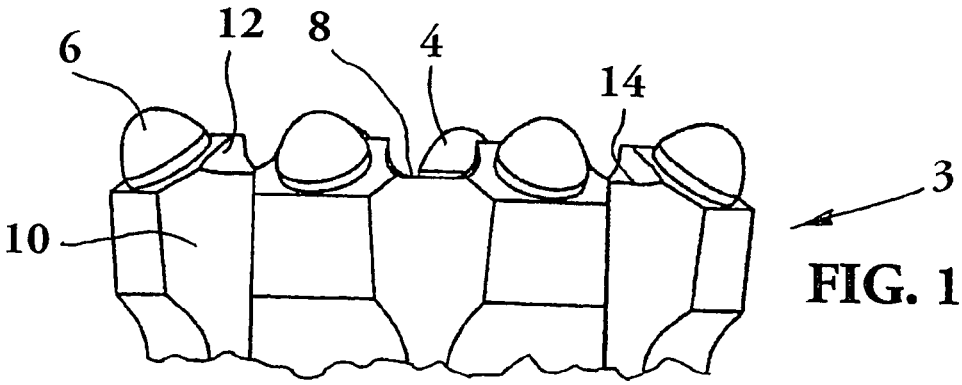
FIG. 1C shows a side view of a front portion of the rock drill bit.

An alternative embodiment of a rock drill bit 1' according to the present invention is shown in FIG. 2, where like numerals depict like features as in the previous embodiment. FIG. 2 is a top view of a quarter of a front of the alternative drill bit according to the present invention. The major differences made to the drill bit 1' when compared to the drill bit according to FIGS. 1A-1C are that each projection 12' is circumferentially more extended and comprises two peripheral buttons 6. The raised portion 12' is mirror imaged about a normal to the center axis intersecting a radially innermost point of the peripheral groove 10. There are as many radial passages 14 as there are raised portions 12'.

The drill bit according to the present invention has numerous other advantages. By having the front face 8 relatively "open" the flushing medium (air and/or water) will not be obstructed from flowing between the raised portions 12. This means that flushing of the front surface 8 will be efficient. By having the peripheral buttons projecting farther forwardly than the front buttons, a guiding rock center will develop during drilling such that straight holes can be achieved (at least 10% straighter holes than prior drill bits in tests). Regrinding is facilitated due to the fact that the raised portions get worn during drilling and thus the need for steel grinding is reduced. The life of the drill bit according to the present invention has been extended by 15-20% when compared to prior drill bits. The relative symmetry of the front surface makes the front face 8 suitable for drill bits for both left hand and right hand drilling which is the case at top hammer and down-the-hole drilling, respectively. Furthermore, the time for machining the front of the drill bit according to the present invention can be reduced.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A rock drill bit for percussive drilling comprising a head portion defining a longitudinal center axis and including a front face; the front face including radially outer and inner portions; a plurality of fluid channels disposed in the head portion and communicating with the inner portion of the front face; the inner portion carrying a plurality of front buttons; the outer portion comprising circumferentially spaced steel portions that are axially raised relative to the inner portion, each raised portion carrying at least one but not more than two peripheral buttons located radially outwardly of an imaginary circle which intersects at least two of the front buttons and at least two of the flushing channels; the imaginary circle arranged coaxially relative to the center axis, wherein circumferentially spaced, longitudinally extending peripheral grooves are formed in an outer periphery of the bit, the front face communicating with each peripheral groove by an additional groove which is inclined radially outwardly and axially rearwardly.

2. The rock drill bit according to claim 1 wherein each raised portion carries only one outer button.

3. The rock drill bit according to claim 1 wherein circumferentially successive raised portions are spaced apart by a radial passage for conducting flushing medium in an outward direction.

4. The rock drill bit according to claim 1 wherein the flushing channels intersect the front face to form respective orifices in the front face, the orifices lying in a plane oriented transversely of the axis and located adjacent radially inner ends of the raised portions.

5. The rock drill bit according to claim 1 further including longitudinal grooves located at a radially outer periphery of the front face.

6. The rock drill bit according to claim 1 wherein the number of flushing channels intersected by the imaginary circle is equal to the number of front buttons intersected by the imaginary circle.

7. The rock drill bit according to claim 1 wherein the total number of peripheral buttons is from 5 to 10.

8. The rock drill bit according to claim 7 wherein circumferentially successive ones of the raised portions are spaced apart by a radial passage for conducting flushing fluid outwardly; the number of radial passages being equal to the number of raised portions.

9. The rock drill bit according to claim 1 wherein each peripheral button projects axially forwardly beyond all front buttons.

10. The rock drill bit according to claim 1 wherein the peripheral grooves extend straight in the axial direction.

11. The rock drill bit according to claim 1 wherein the peripheral buttons are tilted outwardly relative to the center axis.

12. The rock drill bit according to claim 1 wherein the front buttons and the peripheral buttons are made of cemented carbide.

13. The rock drill bit according to claim 1 wherein the front buttons and the peripheral buttons are made of diamond-enhanced cemented carbide.

14. The rock drill bit according to claim 1 comprising a thread coupling.

15. The rock drill bit according to claim 14 wherein the thread coupling has an internal thread.

16. The rock drill bit according to claim 1 comprising a number of retrac edges arranged at a rear end of the rock drill bit.

* * * * *